US009181792B2

(12) United States Patent
Pena

(10) Patent No.: US 9,181,792 B2
(45) Date of Patent: Nov. 10, 2015

(54) METHOD FOR DETECTING AND MITIGATING DRILLING INEFFICIENCIES

(75) Inventor: Cesar Pena, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 964 days.

(21) Appl. No.: 13/333,027

(22) Filed: Dec. 21, 2011

(65) Prior Publication Data

US 2013/0087385 A1 Apr. 11, 2013

Related U.S. Application Data

(60) Provisional application No. 61/543,735, filed on Oct. 5, 2011.

(51) Int. Cl.

| | |
|---|---|
| ***E21B 44/00*** | (2006.01) |
| ***E21B 7/00*** | (2006.01) |
| ***E21B 7/24*** | (2006.01) |
| *E21B 44/04* | (2006.01) |
| *E21B 10/00* | (2006.01) |

(52) U.S. Cl.
CPC . *E21B 44/00* (2013.01); *E21B 7/24* (2013.01); *E21B 10/00* (2013.01); *E21B 44/04* (2013.01)

(58) Field of Classification Search
CPC ..... E21B 44/00; E21B 44/04; E21B 10/00; E21B 7/24
USPC ..... 702/9
See application file for complete search history.

(56) References Cited

U.S. PATENT DOCUMENTS

| | | | | |
|---|---|---|---|---|
| 5,318,136 | A * | 6/1994 | Rowsell et al. | 175/24 |
| 6,944,547 | B2 | 9/2005 | Womer et al. | |
| 7,142,986 | B2 | 11/2006 | Moran | |
| 7,172,037 | B2 | 2/2007 | Dashevskiy et al. | |
| 7,938,197 | B2 | 5/2011 | Boone et al. | |
| 2008/0156531 | A1 | 7/2008 | Boone et al. | |
| 2009/0250264 | A1 | 10/2009 | Dupriest | |
| 2010/0032165 | A1 | 2/2010 | Bailey et al. | |
| 2012/0130693 | A1 * | 5/2012 | Ertas et al. | 703/2 |
| 2012/0323495 | A1 * | 12/2012 | Zhou et al. | 702/9 |

FOREIGN PATENT DOCUMENTS

WO 2011016927 A1 2/2011

OTHER PUBLICATIONS

International Search Report and Written Opinion issued Mar. 4, 2013 in corresponding International Application No. PCT/US2012/059027 (9 pages).

* cited by examiner

*Primary Examiner* — John Breene
*Assistant Examiner* — Lynda Dinh
(74) *Attorney, Agent, or Firm* — Osha Liang LLP

(57) ABSTRACT

Present embodiments are directed to a drilling system and method for evaluating energy consumption to determine the onset of drilling issues and identify mitigation strategies for more efficient drilling. The drilling system receives drilling parameter values and a drilling performance value from sensors located on a drilling rig, and calculates an energy value based on the drilling parameter values and drilling performance value. The drilling system determines a deviation of the calculated energy value from a desired energy value and identifies one drilling parameter that significantly correlates with the deviation. Further, the drilling system determines an adjustment to the one drilling parameter that, when applied, causes the calculated energy value to approach the desired energy value. The drilling system then indicates the desired adjustment to the drilling operator so that appropriate actions may be taken to mitigate the drilling issue.

19 Claims, 5 Drawing Sheets

METHOD FOR DETECTING AND MITIGATING DRILLING INEFFICIENCIES

CROSS REFERENCE TO RELATED APPLICATIONS

This application claims the benefit of U.S. Provisional Patent Application No. 61/543,735, entitled "Entropy-Based Drilling Optimization", filed Oct. 5, 2011, which is herein incorporated by reference.

BACKGROUND

The present disclosure relates generally to the field of drilling and processing of wells. More particularly, present embodiments relate to using energy consumption evaluation for detecting drilling issues and determining appropriate mitigation strategies.

In conventional oil and gas operations, a well is typically drilled to a desired depth with a drill string, which includes drill pipe and a drilling bottom hole assembly (BHA). Throughout this process, several drilling parameters generally affect drilling performance (i.e., rate at which the well is drilled to the desired depth). These parameters may include, among others, load applied to the BHA, rotational speed of the drill string being turned by a top drive or kelly drive, torque applied at the rotating BHA, and flow rate of drilling mud pumped through the drill string. The drilling performance and drilling parameters are typically monitored throughout the drilling process.

Rig operators often rely on the drilling performance in order to make decisions and/or to make adjustments to the drilling parameters during drilling operation. However, this performance may fluctuate rapidly due to variability in the mechanical and hydraulic setup of the drilling rig and/or noise in sensors used to monitor the parameters. Due to the inherent variability of the drilling performance, it may be difficult for rig operators to detect the onset of drilling issues, especially when the drilling issues originate down-hole in response to geo-mechanical or lithological phenomena. Failure to react to such drilling issues in a timely manner frequently leads to low performance, and attempts to mitigate the issues, once recognized, are not always effective. Occasionally, mitigation attempts exacerbate the drilling issue, causing equipment damage, consumable losses, and extended periods of non-productive time.

BRIEF DESCRIPTION

It is now recognized that there exists a need for improved and different systems and methods for identifying a drilling issue at its onset and determining the appropriate adjustments to certain drilling parameters for mitigating the drilling issue. Accordingly, present embodiments are directed to systems and methods that use relative energy consumption evaluation to identify drilling issues and to recommend drilling parameter adjustments in response to the issues. Certain disclosed embodiments include a drilling system capable of analyzing drilling parameter values (e.g., weight on bit, rotational speed of a drilling feature, torque applied by the drilling feature, drilling mud flow rate, etc.) and drilling performance values (e.g., one or more values indicative of drilling progression) in real time to identify the onset of drilling issues and determine appropriate mitigation strategies. Indeed, certain disclosed embodiments are directed to addressing the need for a technique that may allow for early detection and identification of drilling issues so that mitigation strategies may be appropriately applied before the drilling issues become severe. Analysis of drilling parameter values, drilling performance values, and energy consumption over time may also be used to assess drilling efficiency.

In accordance with one aspect of the disclosure, a method includes receiving drilling parameter values related to operation of a drilling rig, where the drilling parameter values include at least a force on a drill bit, a rotational speed of a drilling feature, and a torque applied by the drilling feature. The method also includes receiving a drilling performance value (i.e., a value indicative of drilling progression), and calculating an energy value that is linearly related to the drilling parameter values and proportional to the drilling performance value. In addition, the method includes determining a deviation of the energy value from a desired energy value, and identifying one of the drilling parameter values that significantly correlates with the deviation of the energy value. Further, the method includes determining through statistical analysis an adjustment to the one drilling parameter value such that, when the adjustment is made, the energy value approaches the desired energy value, and indicating the adjustment through a visible or audible output.

Present embodiments also provide a drilling system that includes a communication component configured to receive drilling parameter values and a drilling performance value related to operation of a drilling rig. The drilling parameter values include at least a force on a drill bit, a rotational speed of a drilling feature, and a torque applied by the drilling feature, while the drilling performance value includes a value indicative of drilling progression. The drilling system also includes a memory component configured to store code adapted to calculate an energy value that is linearly related to the drilling parameter values and proportional to the drilling performance value. Further, the drilling system includes a processor coupled to the communication component and the memory component and a display coupled to the processor. The processor is configured to use code stored in the memory component to calculate the energy value and determine an adjustment to one drilling parameter such that, when the adjustment is made, the calculated energy value approaches a desired energy value, and the display is configured to display an indication of the adjustment.

In accordance with another aspect of the disclosure, a non-transitory computer-readable medium includes code adapted to calculate an energy value from received drilling parameter values and a received drilling performance value, the energy value being linearly related to the drilling parameter values and proportional to the drilling performance value. The drilling parameter values include at least a force on a drill bit, a rotational speed of a drilling feature, and a torque applied by the drilling feature, while the drilling performance value includes a value indicative of drilling progression. Additionally, the non-transitory computer-readable medium includes code adapted to identify one of the drilling parameter values that significantly correlates with a deviation of the energy value from a desired energy value as well as code adapted to perform a statistical analysis. This statistical analysis may be used to determine an adjustment to the one drilling parameter value such that, when the adjustment is made, the calculated energy value approaches the desired energy value.

DRAWINGS

These and other features, aspects, and advantages of the present invention will become better understood when the following detailed description is read with reference to the accompanying drawings in which like characters represent like parts throughout the drawings, wherein.

Figure 7:
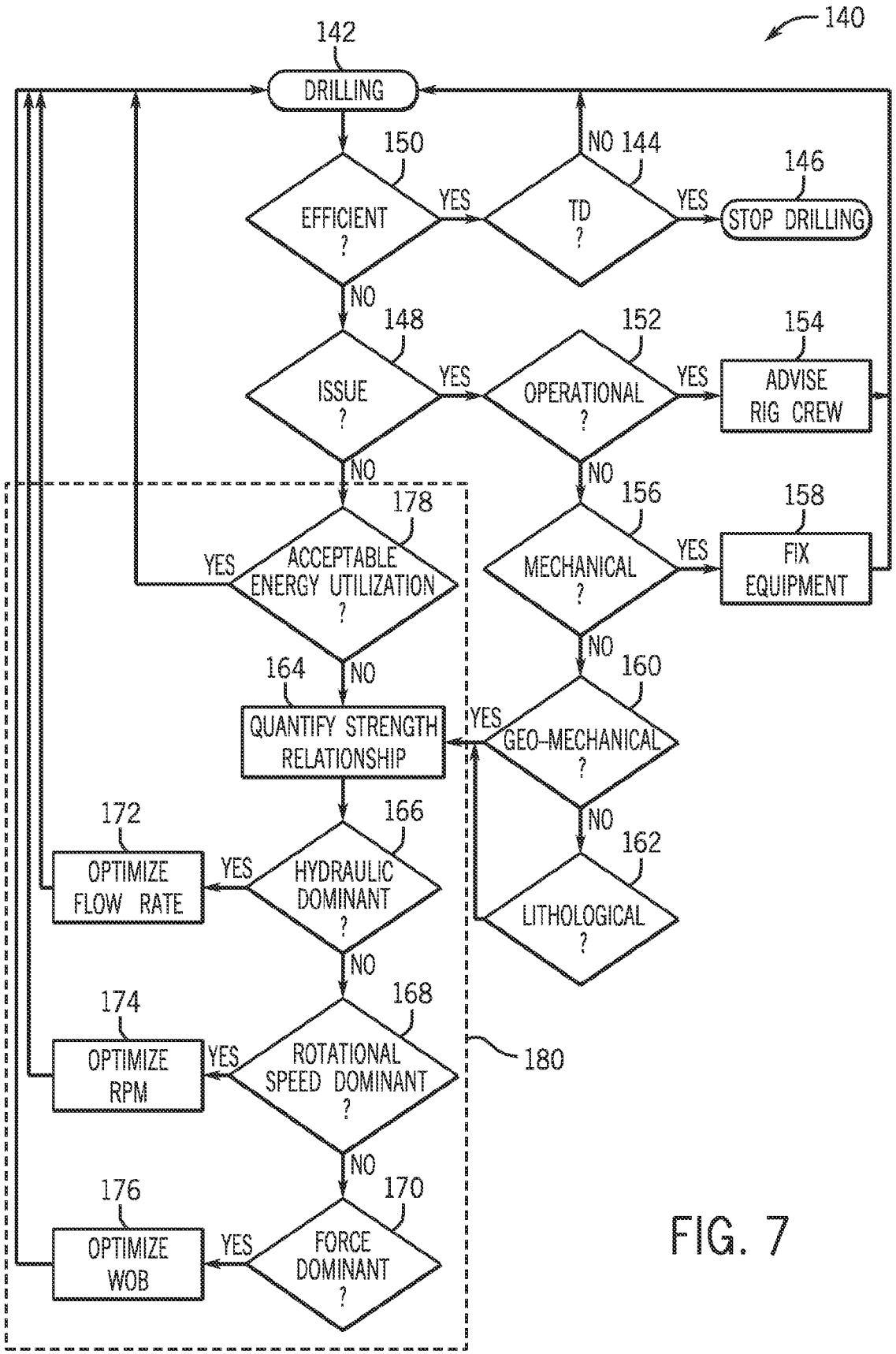
Figure 8:
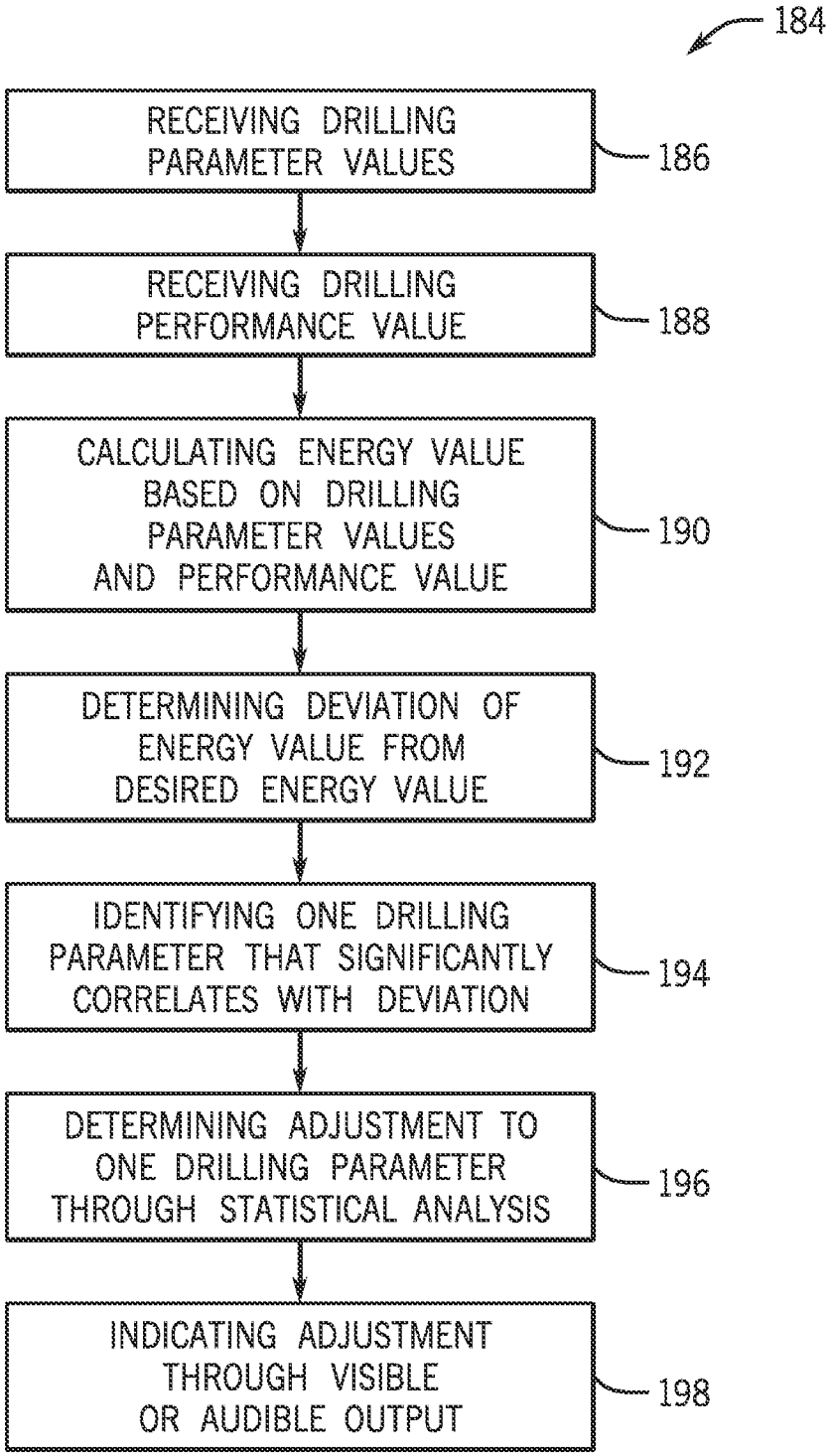

FIG. 7 is a process flow diagram of a method for drilling a well to completion, including determining and mitigating drilling issues and assessing drilling efficiency in accordance with present techniques; and FIG. 8 is a process flow diagram of a method for detecting inefficient drilling and determining an appropriate adjustment to the drilling parameters for mitigating the inefficiency in accordance with present techniques.

DETAILED DESCRIPTION

Present embodiments provide a novel system and method for quantitatively determining the onset of drilling issues through statistical analysis of energy consumption throughout drilling operations. For example, such analysis may include statistical evaluation of relative energy consumption values. The drilling system receives drilling parameter values and a drilling performance value from sensors located on the drilling rig, and calculates an energy value (i.e., a value related to energy consumption) based on the drilling parameter values and drilling performance value. The drilling system then determines a deviation of the calculated energy value from a desired energy value and identifies one drilling parameter that significantly correlates with the deviation. If the deviation exceeds a certain threshold, the drilling system determines an adjustment to the one drilling parameter through statistical analysis (e.g., a linear regression) that, when applied, causes the calculated energy value to approach the desired energy value. Finally, the drilling system may indicate the desired adjustment, on a visible display or as an audible alert, to the drilling operator so that appropriate actions may be taken to mitigate the drilling issue.

Figure 1:
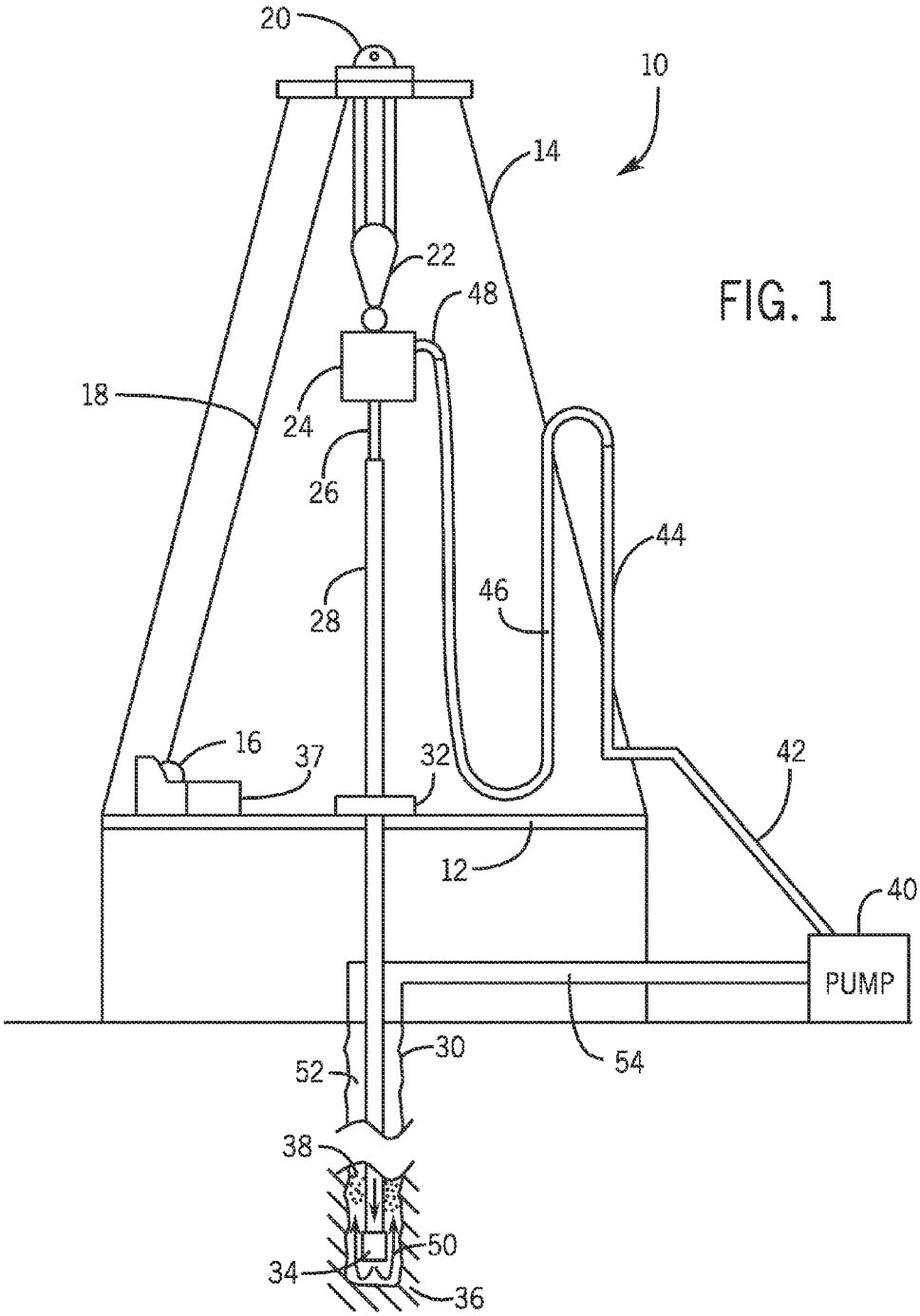
FIG. 1 is a schematic of a well being drilled in accordance with present techniques.

Turning now to the drawings, FIG. 1 is a schematic representation of a drilling rig 10 in the process of drilling a well in accordance with present techniques. The drilling rig 10 features an elevated rig floor 12 and a derrick 14 extending above the floor 12. A drawworks 16 supplies drilling line 18 to a crown block 20 and traveling block 22 in order to hoist various types of drilling equipment above the rig floor 12. The traveling block 22 may support a top drive 24, which features a quill 26 used to turn tubular or other drilling equipment. In the illustrated embodiment, the quill 26 is coupled with a drill string 28, which is a total length of connected casing, drill pipe, or the like, extending into a well bore 30. One or more motors housed in the top drive 24 facilitate the rotation of the drill string 28 at a desired speed as specified by a rig operator.

While a new tubular length is being attached to the drill string 28, the drill string 28 may be held stationary with respect to the rig floor 12 by a rotary table 32. In order to advance the well bore 30 to greater depths, the drill string 28 features a bottom hole assembly (BHA), which includes a drill bit 34 for crushing or cutting rock away from a formation 36. Drilling mud may be circulated through the drilling rig 10 in order to remove cuttings 38 from the well bore 30. A mud pump 40 pumps the drilling mud through a discharge line 42, stand pipe 44, rotary hose 46, and gooseneck 48 leading into the top drive 24. From here the drilling mud flows through the top drive 24 and down a channel through the drill string 28, exiting the drill string 28 through the drill bit 34, as indicated by arrows 50. The mud carries the cuttings 38 away from the drill bit 34 through an annulus 52 formed between the well bore 30 and the drill string 28. A drilling mud return line 54 conveys the drilling mud and the cuttings 38 away from the annulus 52, returning the mud toward the pump 40. The mud, with the cuttings 38, may pass through a series of tanks (not shown) and other components used to separate the cuttings 38 from the drilling mud before the mud is circulated again by the pump 40.

It should be noted that FIG. 1 is merely a representative embodiment, and certain illustrated features may be different in other embodiments. For example, the drilling rig 10 may use a kelly drive system in conjunction with the rotary table 32 to turn the drill string 28 at a desired rotational speed, instead of the top drive 24. In addition, the drill string 28 may remain generally stationary while a down-hole motor located near the BHA rotates the drill bit 34.

Several factors may influence performance of the drilling rig 10, the performance being typically characterized by the speed at which the drill string 28 advances into the well bore 30. For example, the drawworks 16 may contribute to a combined downward force applied to the drill bit 34 known as weight on bit (WOB). That is, the drawworks 16 may provide increasing lengths of drilling line 18 to the crown block 20 and the traveling block 22, increasing the WOB available for cutting forcefully into the formation 36. An autodriller 37 may be present on the drill rig 10 for controlling the drawworks 16 in response to the monitored performance of the drilling rig 10. That is, when the performance of the drilling rig 10 falls below a certain desired performance threshold, the autodriller 37 may utilize a processor and programming to automatically control the drawworks 16 to increase WOB in order to increase the performance.

In addition to WOB, the speed at which the top drive 24 rotates the drill string 28 may influence the performance of the drilling rig 10. Increasing the speed of rotation of the drill string 28 increases the speed at which an outer surface of the drill bit 34, featuring teeth, cutters, and/or inserts contacts the formation 36. The torque applied by the drill bit 34 contacting an inside edge of the formation 36 while cutting rock also influences the performance of the drilling rig 10. Further, the flow rate of drilling mud pumped through the drill string 28 and the well bore 30 may contribute to drilling performance, as a higher flow rate may remove the cuttings 38 from the annulus 52 faster, allowing the drill bit 34 to advance faster. Each of these drilling parameters, as discussed in detail below, may be interrelated, affecting each additional parameter as well as performance and specific energy of the drilling rig 10. When the drilling rig 10 encounters issues that are geo-mechanical, lithological, or related to energy consumption, the parameter values and performance value may be utilized to determine effective mitigation strategies, improving performance and energy utilization of the drilling rig 10.

It should be noted that the drilling rig 10 illustrated in FIG. 1 is intentionally simplified to focus on components contributing to the drilling parameters that may be adjusted to optimize drilling performance as described in the present disclosure. Many other components and tools may be employed during the various periods of formation and preparation of the well bore 30. Similarly, as will be appreciated by those skilled in the art, the orientation and environment of the well bore 30 may vary widely depending upon the location and situation of the formations of interest. For example, rather than a surface (land-based) operation, the well bore 30 may be formed under water of various depths, in which case the topside equipment may include an anchored or floating platform.

Figure 2:
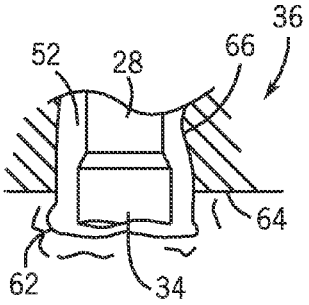
FIG. 2 is a partial cutaway view of a well bore with a drill bit advancing through a rock formation change.
Figure 3:
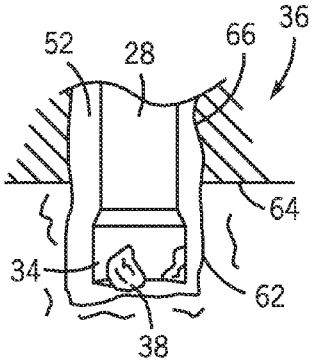
FIG. 3 is a partial cutaway view of the well bore of FIG. 2 with the drill bit accumulating clay shale while advancing through the formation.
Figure 4:
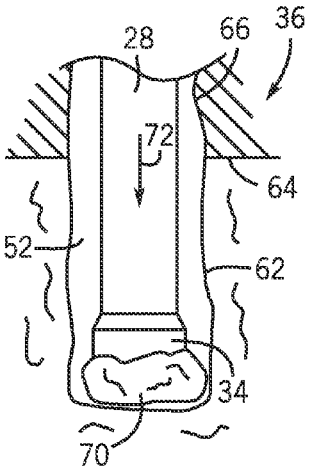
FIG. 4 is a partial cutaway view of the well bore of FIG. 2 showing an occurrence of bit balling.

FIGS. 2-4 illustrate a drilling issue that may be detected and identified through the use of energy consumption analysis in accordance with present techniques. The illustrated issue, known as bit-balling, may occur as the drill string 28 advances into a relatively soft formation, such as clay shale 62 located near a river. FIG. 2 illustrates the drill bit 34 advancing through a formation change 64 from a relatively hard formation, such as black organic shale 66, to the clay shale 62. As the drill bit 34 continues to cut into the clay shale 62, stress release hydration may occur at the bottom of the well bore 30. That is, the force applied by the drill bit 34 to destroy the clay shale 62 may extract water from the clay shale 62 and any other available source of water, including the surface of the drill bit 34. This leads to the cuttings 38 adhering onto the drill bit 34, as shown in FIG. 3. Since this issue generally occurs down-hole as the drill string 28 advances through a formation change 64, it may initially go undetected by operators of the drilling rig 10. In fact, the drilling rig 10 may be equipped with an autodriller that increases the WOB automatically in response to a decreasing rate of penetration (ROP) of the drill string. The end result, as illustrated in FIG. 4, may be a relatively large clay ball 70 formed around the drill bit 34. This clay ball 70 may cover the sharp surfaces of the drill bit 34, reducing the effectiveness of the drill bit 34 and, consequently, reducing the ROP of the drill string 28 beyond an allowable level. Automatically increasing the force applied to the drill string 28, as indicated by arrow 72, may exacerbate the issue further. Present embodiments are directed to drilling systems and methods that may detect the issue of bit-balling at or near its onset, when the drill bit 34 first enters the clay shale 62. As a result, the system may determine that changing the flow rate of drilling mud will likely mitigate the issue.

Figure 5:
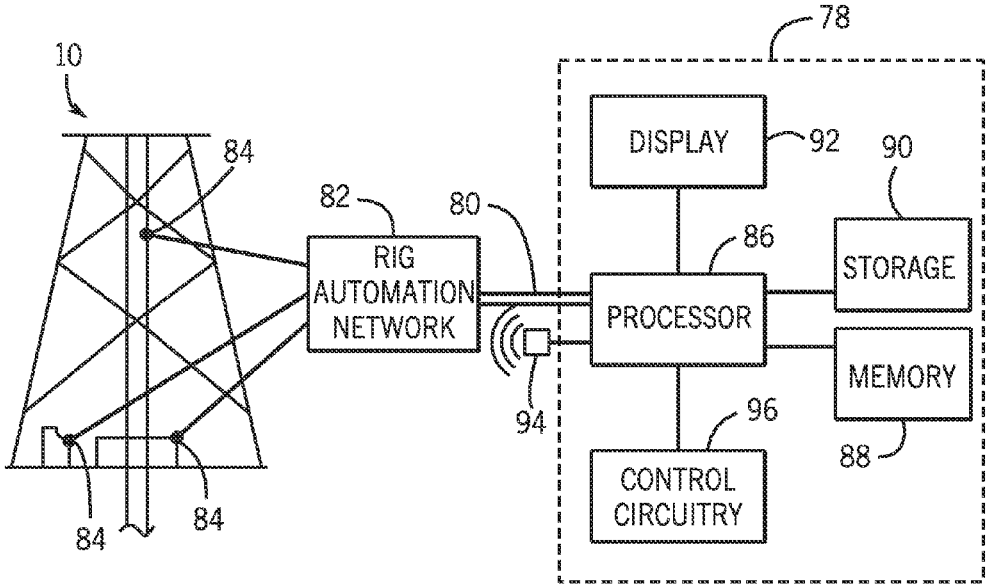
FIG. 5 is a schematic representation of a drilling system configured to determine adjustments to drilling parameter values in accordance with present techniques.

FIG. 5 is a schematic representation of a drilling system 78 used to identify drilling issues, such as bit-balling, and determine effective mitigation strategies. The illustrated drilling system 78 includes a communication component 80, a processor 86, a memory component 88, a storage component 90, a display 92, an audible indication device 94, and control circuitry 96. It should be noted that the illustrated drilling system 78 is meant to be representative, and other drilling systems 78 may include additional components or may operate in the absence of certain illustrated components.

The communication component 80 of the drilling system 78 is configured to receive drilling parameter values and one or more drilling performance values related to operations of the drilling rig 10. The communication component 80 may be a serial cable coupled with a rig automation network 82, which aggregates measurements monitored by a number of sensors 84 placed about the drilling rig 10, as shown in the illustrated embodiment. The sensors 84 may monitor current, voltage, resistivity, force, position, weight, strain, speed, rotational speed, or any other measurement related to drilling parameters or drilling performance, and relevant input values may be aggregated as raw sensor measurements or as scaled engineering values. In one embodiment, the communication component 80 may receive drilling parameter values and a drilling performance value directly from the sensors 84, retrofitted to certain pieces of equipment on the drilling rig 10, such that the sensors 84 effectively form part of the drilling system 78. This type of data acquisition may allow for higher sampling rates to be used for monitoring relevant drilling parameter values and drilling performance values.

The processor 86 of the drilling system 78 may receive various inputs from the communication component 80 such as the drilling parameter values and drilling performance value, and certain calculated values. In addition, the processor 86 may be operably coupled to the memory component 88 and the storage component 90 to execute instructions for carrying out the presently disclosed techniques. These instructions may be encoded in programs that may be executed by the processors 86 to calculate the energy value and determine the appropriate adjustment. The codes may be stored in any suitable article of manufacture that includes at least one tangible non-transitory, computer-readable medium (e.g., a hard drive) that at least collectively stores these instructions or routines, such as the memory component 88 or the storage component 90.

The display 92 coupled with the processor 86 may be used to visibly display the adjustment determined by the processor 86, directing a drilling operator to adjust a drilling parameter appropriately at the onset of a drilling issue. In addition, the display 92 may show traces of at least the drilling parameter values, drilling performance values, and energy values with respect to time. Other values derived from the drilling parameter values, drilling performance value, and energy values may be traced on the display as well. The audible indication device 94 may output an alarm or other audible indication to alert the drilling operator of the onset of a drilling issue and an appropriate parameter adjustment for mitigating the issue. Certain drilling systems 78 may be equipped with control circuitry 96 designed to control certain drilling parameters of the drilling rig 10, such that an adjustment determined by the processor 86 may be automatically implemented in the appropriate drilling equipment. For example, if the processor 86 determines that the flow rate of the drilling mud should be increased in order to prevent bit balling based on analysis of the drilling parameter values, the control circuitry 96 may automatically signal the pump 40 to increase the flow rate.

Figure 6:
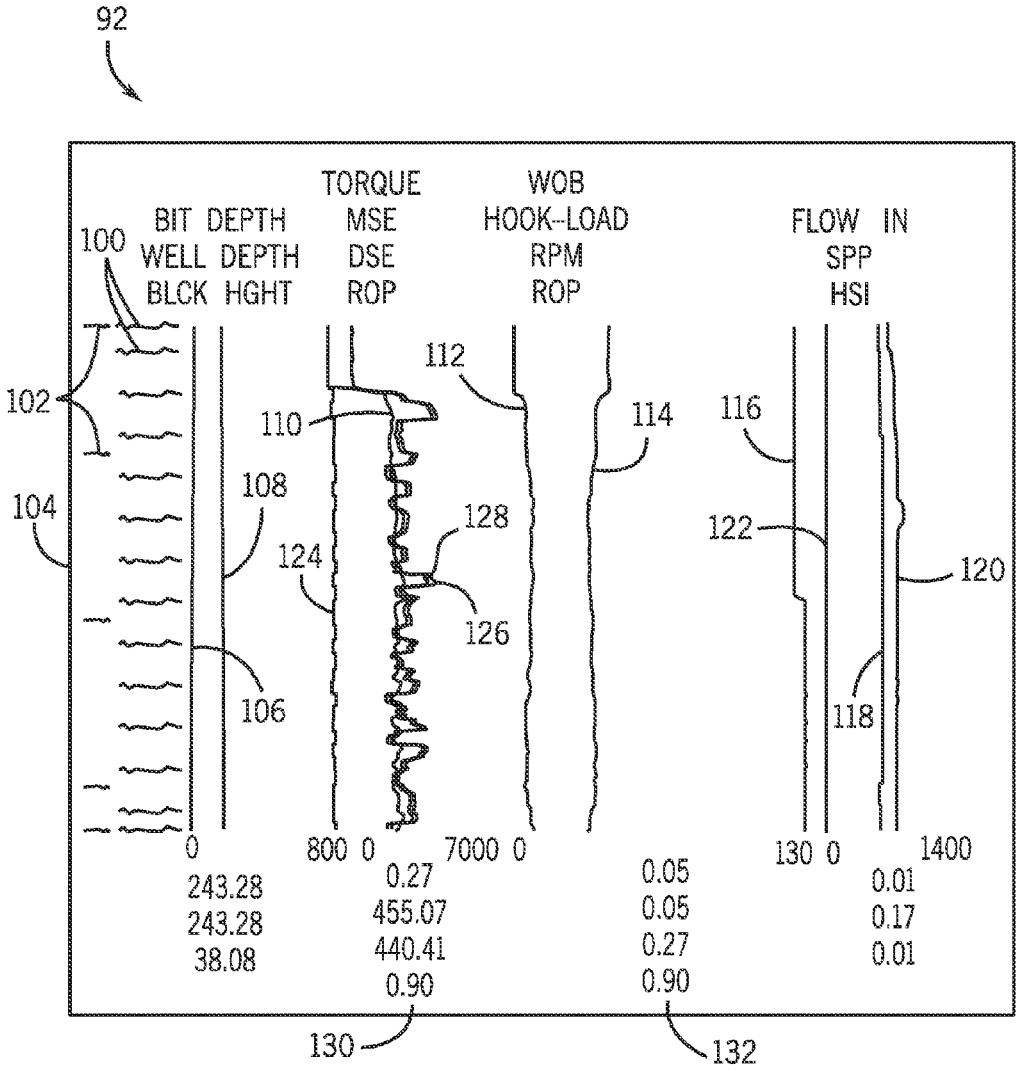
FIG. 6 illustrates a display showing traces of various drilling parameter values, performance parameter values, and energy consumption values in accordance with present techniques.

FIG. 6 is an example representation of the display 92 of the drilling system 78, showing traces related to certain drilling parameter values and performance values that may be used to identify and mitigate drilling issues (e.g., bit-balling, stick/slip vibrations, etc.) in accordance with present techniques. The display 92 includes traces for drilling parameter values that may be aggregated in real-time or with an inherent delay during drilling operations. In the illustrated embodiment, numerical values of time 100 and well depth 102 are displayed along a vertical axis 104. In addition to numerical readouts, the display 92 may show traces of drilling parameter values monitored by the sensors 84, including a block height 106, well depth 108, bit depth (aligned with the well depth 108), torque 110 of a drilling feature (e.g., the drill bit 34), WOB 112, hook-load 114, rotational speed (RPM) 116 of a drilling feature (e.g., the drill bit 34), flow rate 118 of drilling mud, stand pipe pressure (SPP) 120, and hydraulic horsepower per square inch (HSI) 122 of drilling mud. Other drilling parameter values may be received from the sensors 84 or interpreted from sensor data, and some drilling parameter values may be related to others or monitored using the same sensors (e.g., WOB 112 and hook-load 114). In some embodiments, different illustrative techniques may be employed for data representation.

A drilling performance value may be received by the system and traced on the display 92 with respect to time 100 as well. The drilling performance value is a value indicative of drilling progression (e.g., rate of penetration (ROP) 124 of the drill string 28 progressing downward into the well bore 30). In some embodiments, the drilling performance value may be a monitored or calculated drilling efficiency metric. As previously noted, drilling performance values such as the ROP 124 may be affected by the drilling parameter values throughout drilling operation. For example, increasing the WOB 112 provides a greater amount of force to the drill bit 34 for cutting into the formation 36, thereby increasing the ROP 124. The drilling parameters may affect the ROP 124 in different ways depending on the equipment used on the particular drilling rig 10, the sharpness or dullness of the drill bit 34, and certain lithological features of the formation 36, as will be apparent to one skilled in the art. For example, a combination of drilling parameters that may produce a satisfactory level of the ROP 124 in one formation may produce less desirable performance results in another formation.

The display 92 of FIG. 6 features other traces of values that the drilling system may calculate from certain drilling parameters values and the performance value, such as mechanical specific energy (MSE) 126. The MSE 126 is a metric that may be used to determine the linear relationship between increasing drilling parameter values (i.e., RPM 116, WOB 112, and torque 110) and the performance value (ROP 124). Equation (1) below represents a general relationship of the MSE 126 to these drilling parameter values 116, 112, and 110 and the ROP 124:

$$MSE = \frac{WOB}{A_B} + \frac{120 * \pi * RPM * T}{A_B * ROP} \quad \text{equation (1)}$$

Certain drilling parameter values received by the drilling system may be used to calculate a drilling specific energy (DSE) 128 as well, and this relationship is represented in equation (2) below:

$$DSE = \frac{WOB}{A_B} + \frac{120 * \pi * RPM * T}{A_B * ROP} - \frac{1{,}980{,}000 * \lambda * HP_B}{ROP * A_B} \quad \text{equation (2)}$$

The MSE 126 and DSE 128 quantify, linearly, the amount of energy that may be consumed while destroying, through drilling, a given volume of rock. In both specific energy equations (1) and (2), $A_B$ represents a cross-sectional area of the drill bit 34 and T represents the torque 110. For calculating the DSE 128 according to equation (2), $\lambda$ represents a density of the drilling mud, and $HP_B$ represents hydraulic horsepower, which may be calculated from the flow rate 118.

Values of the MSE 126 and DSE 128 of a drilling rig 10 at a given moment may be calculated in a relative manner or an absolute manner. In the illustrated embodiment, the MSE 126 and DSE 128 are calculated in a relative manner through equations (1) and (2) listed above, respectively, though in other embodiments these may be calculated in an absolute manner. An absolute determination of the MSE 126 or DSE 128 may be based partially on factors related to the specific formation 36 being drilled, the equipment (e.g., top drive) used, and other factors that vary from rig to rig. As such, the MSE 126 and DSE 128 may be determined absolutely by referencing logs of typical values of energy consumption for related drilling operations.

It should be noted that the MSE 126 and DSE 128 are each linearly correlated to drilling parameter values including at least WOB 112, RPM 116, and torque 110. The DSE 128 is linearly correlated with the flow rate 118 as well, and both the MSE 126 and DSE 128 are proportional to the ROP 124. Other relative energy values may be calculated such that the energy value is linearly correlated with the drilling parameter values (i.e., at least the WOB 112, RPM 116, and torque 110) and proportional to the ROP 124. In addition, the MSE 126 and DSE 128 may be scaled and/or combined to determine other related metrics that may be useful for energy consumption analysis. Other correlations may be desirable, as will be appreciated by those skilled in the art, that relate energy consumption to various drilling parameter values, drilling performance values, and/or drilling efficiency.

The MSE 126, DSE 128, or other energy value linearly correlated with drilling parameters and proportional to the ROP 124 may be used to assess drilling efficiency. Drilling efficiency may be assessed in terms of consumption of the energy available for cutting rock. That is, calculations may be made to quantify the amount of relative available energy (i.e., the MSE 126 or DSE 128) consumed throughout the process of destroying the formation 36, as quantified by the ROP 124. The illustrated display 92 includes values corresponding to these relative efficiency measurements, specifically a percentage 130 of the MSE 126 being consumed while advancing the well bore 30 and a percentage 132 of the DSE 126 being consumed while advancing the well bore 30. This may be calculated as a ratio of the ROP 124 to the available MSE 126 or DSE 128. FIG. 6 illustrates the percentages 130 and 132 each being equal to 0.90, meaning that ninety percent of the relative MSE 126 and DSE 128 is essentially being used to destroy rock.

As the well bore 30 is advanced, the drilling parameters, including the WOB 112, RPM 116, and torque 110, may be held relatively constant at a desired level. If the formation 36 maintains similar lithological characteristics and the drill bit 34 and other equipment operate as desired, the ROP 124 shown on the display 92 may remain relatively constant. When issues arise, such as the drill string 28 passing through the formation change 64 of FIGS. 2-4 or the drill bit 34 becoming excessively worn and unable to cut properly, the ROP 124 may be affected, and the amount of energy (MSE 126 or DSE 128) available for aspects related to operation of the drilling rig 10 (e.g., destroying rock) may be utilized less efficiently. Therefore, variations in the ROP 124, MSE 126 or DSE 128 may indicate an issue arising down-hole.

Since the drilling parameter values 110, 112, 114, 116, 118, 120, and 122 and the ROP 124 are received from sensor measurements, there may be a certain level of noise in the signals sent from the sensors 84. Such noise, as well as fluctuations in mechanical and hydraulic equipment, may lead to an inherent variation in the parameters used to calculate the MSE 126 and DSE 128, even when the drilling rig 10 operates as desired. However, when issues arise down-hole, the variation of the MSE 126 or DSE 128 may exceed a threshold of acceptable variation. For example, the torque 110, WOB 112, and RPM 116 may remain steady while the ROP 124 decreases, indicating inefficient drilling. In response, an auto-driller coupled with the drawworks 16 may increase the WOB 112 in order to return the ROP 124 to a desired amount. In this case, variation in the ROP 124 may remain relatively constant, but variation in the MSE 126 and DSE 128 may increase as a greater amount of energy is consumed by the drilling system in order to maintain the desired ROP 124.

Variation within the calculated MSE 126 and DSE 128 may be representative of entropy in the drilling rig 10 (i.e., inefficient drilling), indicating the onset of drilling issues such as dysfunction of the drill bit 34, bit balling, slip/stick vibrations of the drill string 28, and the like. To evaluate the amount of variation, the processor 86 of the drilling system 78 may determine a deviation of the calculated energy value (MSE 126, DSE 128, etc.) from a desired energy value. The processor 86 may use code stored in the memory component 88 to calculate the desired energy consumption from previously calculated or observed energy requirements (MSE 126, DSE 128, etc.) that are stored in the memory component 88. Drilling issues may be indicated when the deviation exceeds a threshold value of acceptable variation within the assessment of energy consumption, as determined by a transient standard deviation of the calculated energy value over time. In this way, the level of variability that distinguishes acceptable energy consumption from unacceptable energy consumption may be determined based on typical performance of the drilling rig 10. Indeed, relative values may be utilized based on historical energy consumption values such that present embodiments can be essentially customized for each application.

The drilling system 78 may also identify a specific drilling parameter that may be adjusted to mitigate the issue. For example, the most prominent factor in a particular energy value change may be identified. Once the deviation of the calculated energy value from the desired energy value is determined, a transient standard deviation and/or variance calculation may be used to quantify the weighted contribution of each drilling parameter value to the deviation. Correlation coefficients for each drilling parameter value determined from these calculations may be compared to determine one drilling parameter value that predominantly varies with the deviation of the energy value. Instructions or code adapted to perform this transient standard deviation analysis may be stored in the memory component 88 of the drilling system 78. Once the drilling parameter value that most significantly correlates with the deviation of the energy value is identified, the drilling system 78 may determine, through statistical analysis, an adjustment to the drilling parameter value that may mitigate the issue.

FIG. 7 is a process flow diagram of a method 140 for drilling a well to completion and responding to potential drilling issues throughout the drilling process. The method 140 includes drilling, indicated by block 142, until the well reaches a desired total depth (TD), indicated by block 144. Once the TD is reached, an operator may stop the drilling process, indicated by block 146. However, drilling issues may occur before the well reaches TD, as indicated by block 148, and these drilling issues may need to be addressed before drilling is continued. Drilling efficiency, indicated in block 150, may be evaluated in order to determine the onset of such drilling issues. That is, the relative amount of energy consumed through the drilling process may be quantified and compared with the drilling performance value to determine efficiency of the drilling process. It should be noted that an increase or decrease in drilling efficiency may not equate to a change in ROP, especially when an autodriller is used to alter drilling parameters in order to maintain a certain ROP. Drilling efficiency may also be assessed by processing the time series trends of various measurements taken from rig components throughout the drilling process. Indeed, such measurements as hook-load and SPP may be monitored in order to ascertain optimal levels of these parameters for cleaning cuttings out of the well bore under any drilling environment.

If the calculated drilling efficiency indicates the onset of a drilling issue, the issue may be identified as operational, indicated by block 152. Operational issues may be mitigated through case-based reasoning derived from a local or remote database system or by reference to past performance of the drilling rig completing similar operations, and upon determining an appropriate mitigation strategy, the rig crew may be advised accordingly, as indicated in block 154. The issue may otherwise be mechanical, as indicated in block 156, identified reactively or predictively by mechanical health monitoring systems. Mechanical issues may be mitigated through appropriate maintenance, repairs, or replacement of drilling equipment, as indicated by block 158. To that end, a computerized system may be used to trigger supply-chain processes for replenishing spares, tools, consumables, and the like. Other issues that may be identified from the drilling efficiency calculation include geo-mechanical and lithological issues, as shown in blocks 160 and 162, respectively. In order to mitigate these issues, disclosed embodiments may be utilized to quantify a strength relationship between the inefficiency and the drilling parameters, as indicated by block 164. The results of this evaluation may be hydraulic dominant, rotational speed dominant, or force dominant, as indicated by blocks 166, 168, and 170, respectively. In the hydraulic dominant case, the flow rate may be optimized, indicated by block 172, in order to increase drilling efficiency, thereby mitigating the issue. Likewise, in the rotational speed dominant case, the RPM may be adjusted to mitigate the issue, as in block 174, and in the force dominant case, the WOB may be adjusted, as in block 176.

Relative energy quantification, indicated in block 178, may be used to distinguish between drilling operations with normally low performance values and drilling issues that may be mitigated through the correlation strength quantification of block 164. This energy quantification 178 involves determining the deviation of a relative energy value from a desired value, as previously discussed. When a drill bit is dull or a formation is particularly hard, the energy quantification of block 178 may differentiate between drilling issues that may be mitigated by adjusting the drilling parameters or normally low performance of the drilling rig 10, since the energy values are compared with previous values of energy consumption.

The method 140 also illustrates block 180, which contains the energy quantification, strength relationship quantification, and mitigation techniques related to each dominant drilling parameter. Block 180 is representative of the process performed on each set of drilling parameter values and drilling performance values received by the drilling system. In addition, the drilling system may continually analyze energy consumption over time, in order to ascertain the effectiveness of mitigation strategies that are used. By continually determining deviations of energy consumption and necessary adjustments to drilling parameter values, the drilling system may allow for relatively more efficient drilling throughout the well formation process.

FIG. 8 is a process flow diagram of a method 184 for identifying and addressing drilling issues through energy consumption analysis in accordance with present techniques. It should be noted that the method 184 may be implemented as a computer or software program (e.g., code or instructions) that may be executed by the processor 86 to execute one or more of the steps of the method 184. Additionally, the program (e.g., code or instructions) may be stored in any suitable article of manufacture that includes at least one tangible non-transitory, computer-readable medium that at least collectively stores these instructions or routines, such as the memory component 88 or the storage component 90.

The method 184 includes receiving drilling parameter values related to operation of a drilling rig, as indicated in block 186. The drilling parameter values include at least a force on a drill bit of the drilling system, a rotational speed of a drilling feature, and a torque applied by a drilling feature (e.g., for cutting rock). The drilling parameter values may also include flow rate of drilling mud pumped through the drilling rig, among other related parameters. These drilling parameter values may be monitored via sensors located about the drilling rig. In addition to receiving drilling parameter values, the method 184 includes receiving a drilling performance value, as indicated in block 188. This drilling performance value, which is indicative of drilling progression, may include a drilling efficiency value or a value related to the rate of penetration (ROP), i.e. the rate at which a drill string of the drilling rig is advanced into a well bore. The method 184 also includes calculating an energy value based on the drilling parameter values and the performance value, as indicated in block 190. The energy value may be MSE, DSE, or some other energy value that is linearly related to the drilling parameter values and proportional to the drilling performance value. This energy value may be representative of energy consumed in the process of destroying rock. Further, the method 184 includes determining a deviation of the calculated energy value from a desired energy value, as indicated in block 192. The deviation may indicate onset of a drilling issue if the deviation is larger than a standard deviation of the energy values calculated over an extended period of time.

In response to a relatively large deviation that indicates entropy or a drilling issue, the method 184 includes identifying one drilling parameter value that significantly correlates with the deviation of the energy value, as shown in block 194. The drilling parameter value may be determined through a transient standard deviation and/or variance analysis of the drilling parameter values with respect to the deviation of the energy value. Correlation coefficients, expressed in terms of probability, for the relationship of each drilling parameter value to the deviation of the energy value may be calculated and compared. Indeed, the drilling parameter value that significantly correlates to the deviation may be the drilling parameter value that most predominantly varies with the calculated energy value (i.e., the drilling parameter value with the highest correlation coefficient). As shown in block 196, the method 184 further includes determining an adjustment to the one drilling parameter value through statistical analysis such that, when the adjustment is made to the drilling parameter value, the calculated energy value approaches the desired energy value. The statistical analysis may involve performing a single and/or multi-variable linear regression analysis to predict the effect of changing the one drilling parameter value on the other drilling parameter values, drilling performance values, and energy values. Finally, the method 184 includes indicating the adjustment through a visible or audible output, as indicated in block 198. The output may include an audible alarm or a visual display showing both a prediction of the drilling issue associated with the deviation of the energy value and the adjustment determined to mitigate the drilling issue. In some embodiments, automatic adjustments may be performed to compensate for the drilling issue.

The method 184 may include continuing interpretation of correlation coefficients that relate the drilling parameter values to the deviation of the energy value throughout drilling operations. This may inform rig operators of the effectiveness of adjustments identified using the method 184. By continually analyzing energy consumption in this way and making appropriate adjustments to drilling parameters, the method 184 may extend the life of the drill bit, improve well bore quality, and reduce non-productive time during drilling processes. In addition, drilling efficiency may be assessed by processing the time series trends of the different drilling parameters and measurements.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A method, comprising:

sending drilling parameter values from one or more sensors to a communication component, the drilling parameter values related to operation of a drilling rig and comprising at least a force on a drill bit, a rotational speed of a drilling feature, and a torque applied by the drilling feature;

sending a drilling performance value from the one or more sensors to the communication component, the drilling parameter values comprising a value indicative of drilling progression;

calculating an energy value that is linearly related to the drilling parameter values and proportional to the drilling performance value with a processor;

determining, by the processor, a deviation of the energy value from a desired energy value at the onset of a drilling issue;

identifying, by the processor, one of the drilling parameter values that significantly correlates with the deviation of the energy value;

determining, by the processor, using statistical analysis, and outputting an adjustment to the one of the drilling parameter values;

adjusting, by the processor, the one of the drilling parameter values such that, when the adjustment is made, the energy value approaches the desired energy value.

2. The method of claim 1, comprising monitoring the drilling parameter values and the drilling performance value via sensors disposed about the drilling rig.

3. The method of claim 1, comprising receiving drilling parameter values comprising a flow rate of drilling mud flowing through the drilling rig.

4. The method of claim 1, comprising receiving a drilling performance value comprising a rate of penetration of a drilling feature into a well.

5. The method of claim 1, comprising comparing the deviation of the energy value with a standard deviation of energy values calculated over time.

6. The method of claim 1, wherein identifying the one drilling parameter value comprises identifying one of the drilling parameter values that predominantly varies with the deviation of the energy value.

7. The method of claim 1, wherein determining the adjustment comprises performing a linear regression analysis of the one drilling parameter value compared with each other drilling parameter value, the drilling performance value, and the energy value, based on past performance of the drilling rig.

8. The method of claim 1, further comprising indicating the adjustment through a visible or audible output by displaying a prediction of a drilling issue associated with the deviation of the energy value and displaying the adjustment determined to mitigate the drilling issue.

9. The method of claim 1, comprising controlling the drilling rig to apply the adjustment.

10. A drilling system comprising:

one or more sensors disposed about a drilling rig to measure drilling parameter values and a drilling performance value related to operation of a drilling rig, the drilling parameter values comprising at least a force on a drill bit, a rotational speed of a drilling feature, and a torque applied by the drilling feature and the drilling performance value comprising a value indicative of drilling progression;

a communication component configured to receive the drilling parameter values and the drilling performance value from the one or more sensors;

a memory component configured to store code adapted to calculate an energy value that is linearly related to the drilling parameter values and proportional to the drilling performance value, wherein the memory component is configured to store code adapted to identify one of the drilling parameter values that predominantly varies with the deviation of the energy value;

a processor coupled to the communication component and the memory component and configured to use code stored in the memory component to calculate the energy value and determine an adjustment to one drilling parameter such that, when the adjustment is made, the calculated energy value approaches a desired energy value; and a display coupled to the processor and configured to display an indication of the adjustment.

11. The drilling system of claim 10, wherein the processor is configured to determine a deviation of the calculated energy value from the desired energy value.

12. The drilling system of claim 10, comprising an audible indication device configured to produce an audible indication of the adjustment.

13. The drilling system of claim 10, comprising sensors disposed on the drilling rig and configured to monitor the drilling parameter values and the drilling performance value.

14. The drilling system of claim 10, wherein the display is configured to display traces of at least the drilling parameter values, drilling performance value, and calculated energy value with respect to time.

15. The drilling system of claim 10, wherein the memory component is configured to store calculated energy values with respect to time for calculating the desired energy value.

16. A non-transitory computer-readable medium comprising instructions which when executed by a processor performs the following method:

receiving drilling parameter values from one or more sensors, the drilling parameter values related to operation of a drilling rig and comprising at least a force on a drill bit, a rotational speed of a drilling feature, and a torque applied by the drilling feature;

receiving a drilling performance value from the one or more sensors, the drilling parameter values comprising a value indicative of drilling progression;

calculating, by the processor, an energy value from the drilling parameter values and the drilling performance value received from the one or more sensors, the energy value being linearly related to the drilling parameter values and proportional to the drilling performance value;

identifying, by the processor, one of the drilling parameter values that significantly correlates with a deviation of the energy value from a desired energy value at the onset of a drilling issue;

performing, by the processor, using a statistical analysis for determining an adjustment to the one of the drilling parameter values such that, when the adjustment is made, the energy value approaches the desired energy value; and outputting, by the processor, the adjustment to the one of the drilling parameter values.

17. The non-transitory computer-readable medium of claim 16, wherein the identifying further comprises performing a transient standard deviation analysis of the drilling parameter values to identify the one drilling parameter that predominantly varies with the deviation.

18. The non-transitory computer-readable medium of claim 16, further comprising calculating the desired energy value based on previously calculated energy values.

19. The non-transitory computer-readable medium of claim 16, further comprising performing a linear regression analysis for determining the adjustment.

* * * * *